US007334705B2

(12) United States Patent
Yashima et al.

(10) Patent No.: US 7,334,705 B2
(45) Date of Patent: Feb. 26, 2008

(54) CONTAINER

(75) Inventors: Noboru Yashima, Tokyo (JP); Yoshinori Inagawa, Tokyo (JP)

(73) Assignee: Kao Corporation, Tokyo (JP)

( * ) Notice: Subject to any disclaimer, the term of this patent is extended or adjusted under 35 U.S.C. 154(b) by 112 days.

(21) Appl. No.: 10/469,035

(22) PCT Filed: Feb. 25, 2002

(86) PCT No.: PCT/JP02/01670

§ 371 (c)(1),
(2), (4) Date: Aug. 26, 2003

(87) PCT Pub. No.: WO02/068286

PCT Pub. Date: Sep. 6, 2002

(65) Prior Publication Data

US 2004/0065686 A1 Apr. 8, 2004

(30) Foreign Application Priority Data

Feb. 26, 2001 (JP) ..... 2001-050683
Jun. 18, 2001 (JP) ..... 2001-183970
Jul. 11, 2001 (JP) ..... 2001-211373

(51) Int. Cl.
*B67D 5/56* (2006.01)

(52) U.S. Cl. ..... 222/129; 222/183; 222/485

(58) Field of Classification Search ..... 222/131, 222/183, 129, 145.1, 546, 94, 129.1, 485
See application file for complete search history.

(56) References Cited

U.S. PATENT DOCUMENTS 3,136,458 A * 6/1964 Ruetz ..... 222/546
3,197,066 A 7/1965 Dender et al.
3,217,931 A * 11/1965 Farrar et al. ..... 222/485
3,341,046 A * 9/1967 Bereziat et al. ..... 222/546
3,369,710 A 2/1968 Lucas
3,860,152 A * 1/1975 Marti ..... 222/545
4,133,462 A * 1/1979 Lindstrom ..... 222/546
4,387,819 A * 6/1983 Corsette ..... 222/546
4,531,657 A * 7/1985 Saito et al. ..... 222/108
4,585,150 A * 4/1986 Beacham et al. ..... 222/129
4,678,103 A * 7/1987 Dirksing ..... 222/129
4,730,381 A 3/1988 Dirksing
4,993,595 A * 2/1991 Bertram et al. ..... 222/129
5,647,510 A * 7/1997 Keller ..... 222/94
5,850,953 A 12/1998 Dallas, Jr.
2005/0051576 A1* 3/2005 Brugner ..... 222/145.1

FOREIGN PATENT DOCUMENTS

DE 35 14 133 10/1986
DE 9112317 1/1992
JP 62-146165 6/1987

* cited by examiner

*Primary Examiner*—Philippe Derakshani
(74) *Attorney, Agent, or Firm*—Oblon, Spivak, McClelland, Maier & Neustadt, P.C.

(57) ABSTRACT

The invention provides a container 10 which simultaneously discharges agents A and B respectively charged in an outer container 11 and an inner container 21 from an outer nozzle portion 40C and an inner nozzle portion 40D in accordance with a tilting of the container 10.

8 Claims, 7 Drawing Sheets

CONTAINER

TECHNICAL FIELD

The present invention relates to a container which is preferable for simultaneously discharging and mixing plural kinds of agents such as liquids, fine particles and the like.

BACKGROUND ART (A) In Japanese Patent Application Laid-Open No. 11-189251, there is described a two-liquid extrusion container provided with an outer tube and an inner tube, in which respective interior liquid solutions are simultaneously discharged from an entire periphery of an outer nozzle in the outer tube and an entire periphery of an inner nozzle in the inner tube, on the basis of a squeezing deformation of the container.

The background art mentioned above has the following problems.

(1) Since it is indispensable for the two-liquid extrusion container to squeeze the container for discharging the interior liquid solutions in the outer container and the inner container, it is impossible to simultaneously discharge the interior liquid solutions only by tilting the container.

(2) Since the container is the two-liquid extrusion container, the interior liquid solution is always extruded from the entire peripheries of the outer nozzle and the inner nozzle, and can not be discharged from a part of the nozzle in the peripheral direction. Accordingly, there is no object of making a rate of discharge amount of the liquid discharged from an optional part of the outer nozzle and the inner nozzle in the peripheral direction constant, in correspondence to a grip position of the container in the peripheral direction performed by a user.

An object of the present invention is to simultaneously discharge an agent in an outer container and an agent in an inner container only by tilting a container.

Further, another object of the present invention is to simultaneously discharge the agent in the outer container and the agent in the inner container from any portion of their nozzles in a peripheral direction at a fixed rate of discharge.

(B) Further, conventionally, in a container in which the inner container is received in the outer container, an outer nozzle connected to the outer container and an inner nozzle connected to the inner container are fitted to each other.

The background art mentioned above has the following problems.

A connection member interposed between the outer container and the inner container and connecting them is constituted by two mutually fitted members comprising the outer nozzle and the inner nozzle. Accordingly, if a fitting force between the outer nozzle and the inner nozzle is small, the fitting between both the nozzles is separated into two nozzles in transit or in use, so that the inner container is separated from the outer container so as to drop out.

An object of the present invention is to prevent the inner container from dropping out in the container in which the inner container is connected to the outer container.

(C) Further, there is a container having a discharge port which a measuring cap is attached to and detached from, in which an agent recovery portion is provided in a periphery of the discharge port. A residual liquid at a previous measuring time left in the measuring cap is recovered in the agent recovery portion via the measuring cap.

The background art mentioned above has the following problems.

If the container is tilted at a next using time of the container, the recovered liquid stored in the agent recovery portion drips off and runs down from an outer edge of the agent recovery portion, thereby soiling the periphery.

An object of the present invention is to recover the agent left in the measuring cap and pour the recovered agent together with the discharge agent from a main discharge port at the next using time without dripping off the recovered agent.

DISCLOSURE OF THE INVENTION

In accordance with the present invention, there is provided a container comprising: an inner container received in an outer container; and an inner nozzle portion received in an outer nozzle portion, in which agents respectively charged in the outer container and the inner container are simultaneously discharged from an outer discharge port of the outer nozzle portion and an inner discharge port of the inner nozzle portion by tilting the container, wherein the outer nozzle portion and the inner nozzle portion are coaxially arranged, an inner discharge port of the inner nozzle portion is formed in a trumpet shape, and the inner discharge port of the inner nozzle portion protrudes to an outer side from the outer discharge port of the outer nozzle portion in an axial direction of the container.

Further, in accordance with the present invention, there is provided a container comprising: an inner container received in an outer container; and an inner nozzle portion received in an outer nozzle portion, in which agents respectively charged in the outer container and the inner container are simultaneously discharged from an outer discharge port of the outer nozzle portion and an inner discharge port of the inner nozzle portion by tilting the container, wherein an agent recovery portion is provided in a periphery of the outer discharge port and the inner discharge port, a partition member is provided in an outer periphery of the agent recovery portion, a measuring cap is detachably provided in the partition member, and the partition member is provided with an agent introduction recess portion configured to introduce the agent in an outer periphery thereof, the agent introduction recess portion configured to be communicated with the agent recovery portion by a communication port, the communication port provided in a portion positioned at an opposite side to a portion close to a pouring direction of the outer discharge port and the inner discharge port with respect to the outer discharge port and the inner discharge port in a peripheral direction of the partition member, and a sub-discharge port connected to the agent recovery portion is formed to rise up from the agent introduction recess portion.

BEST MODE FOR CARRYING OUT THE INVENTION (First Embodiment) (FIGS. 1 to 6)

Figure 1:
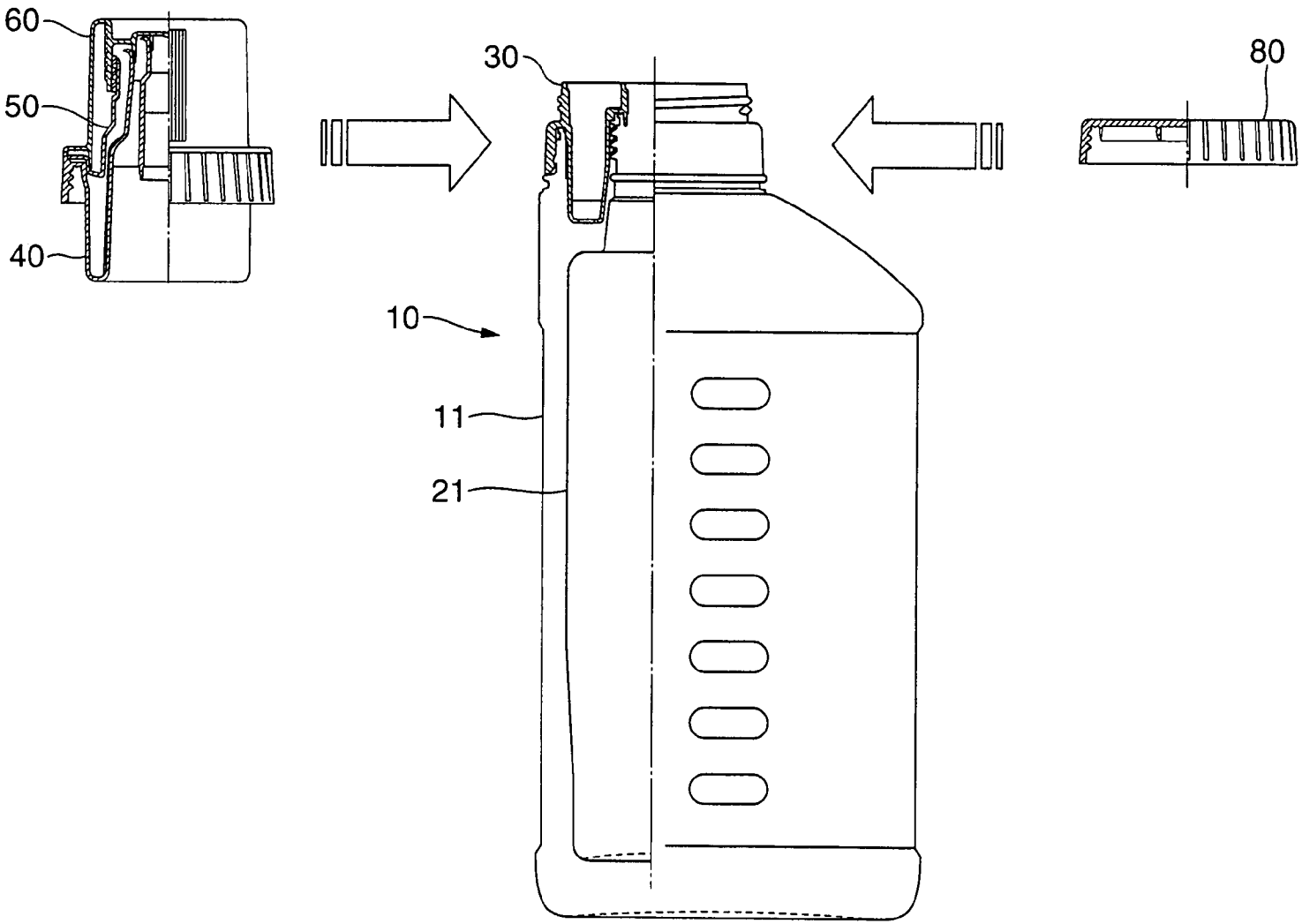
FIG. 1 is a schematic view showing a container in accordance with a first embodiment.

A container 10 is a two-agent discharge container which simultaneously discharges two agents A and B (for example, a detergent or an alkali agent containing a surface active agent, and an oxygen type bleaching agent containing a surface active agent) in which at least one agent A (or B) of two different agents A and B having natures being reacted by mixing, contains a surface active agent. The container 10 is structured, as shown in FIG. 1, such that an inner container 21 having an opening at one end is received in an outer container 11 having an opening at one end, and the outer container 11 and the inner container 21 are connected by a single connecting member 30. That is, a drive-in portion 31 of the connecting member 30 is drive-in connected to a drive-in portion 11A in an opening portion of the outer container 11 so as to seal, and an inner peripheral threaded portion 32 of the connecting member 30 is screw connected to a threaded portion 21A in an opening portion of the inner container 21 so as to seal.

Figure 2:
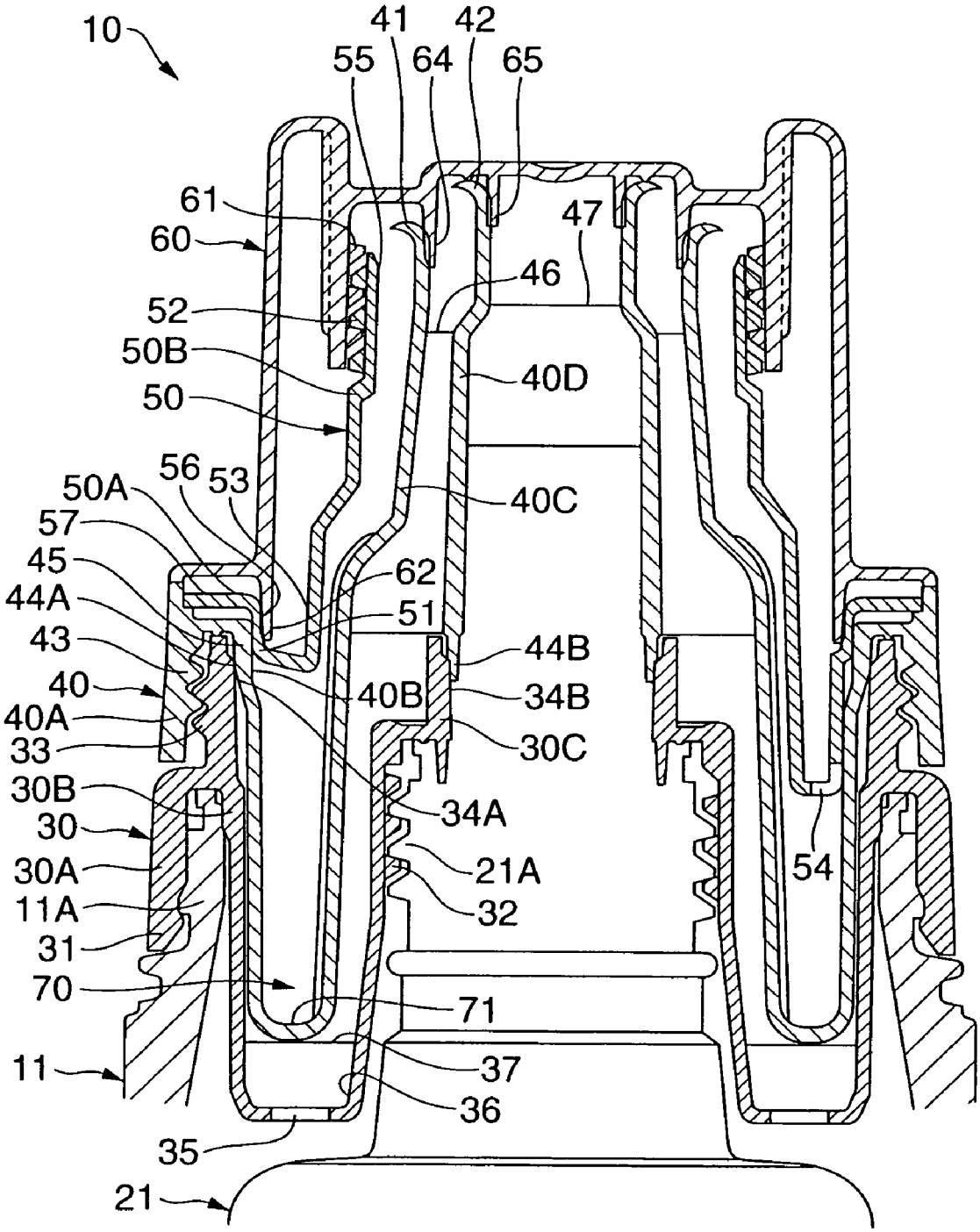
FIG. 2 is an enlarged cross sectional view of a main portion of the container in accordance with the first embodiment.
Figure 3:
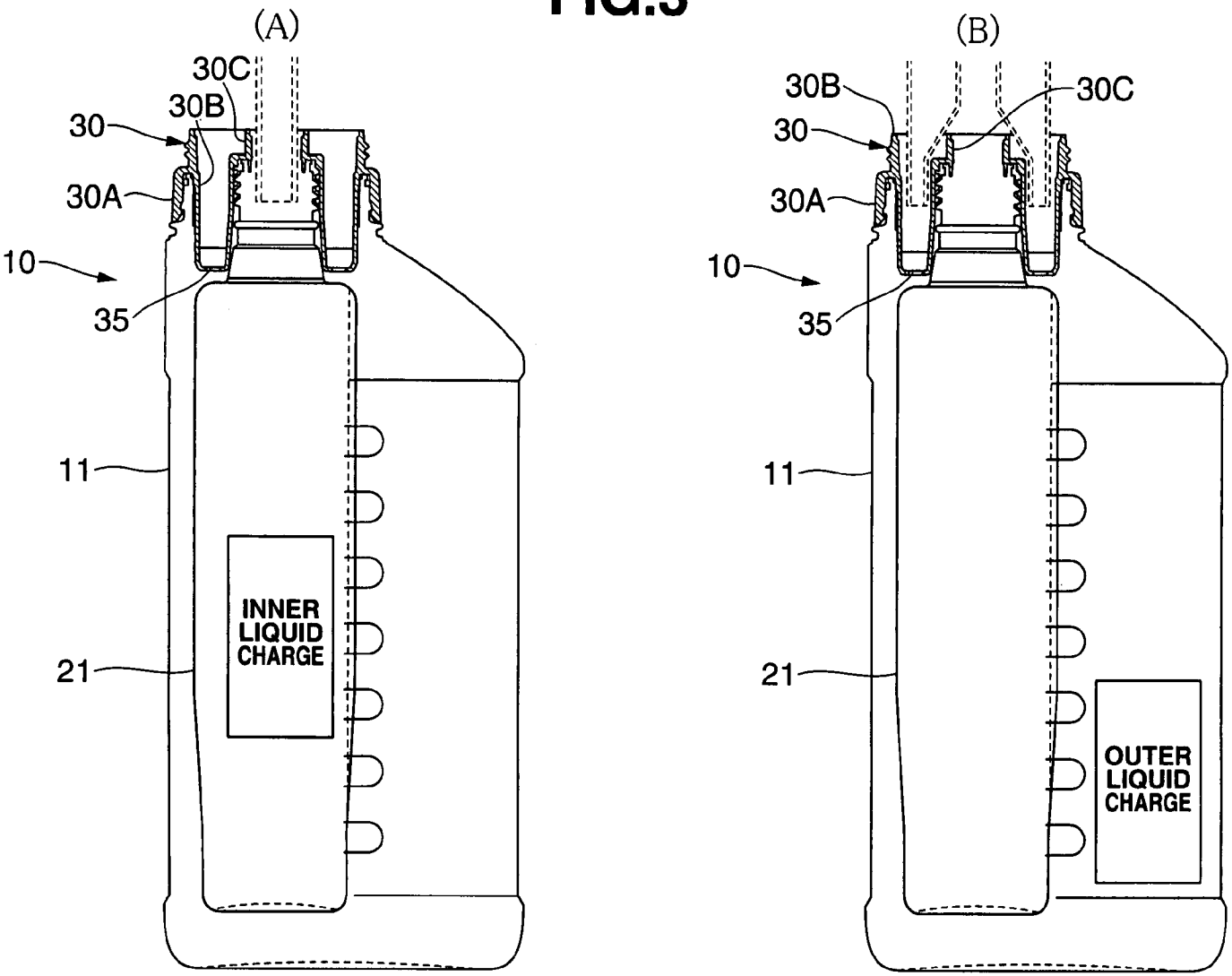
FIG. 3 is a schematic view showing a state of charging into the container.

The container 10 is structured, as shown in FIGS. 1 and 2, such that a nozzle body 40 can be attached to and detached from the connecting member 30 by an outer periphery annular attaching and detaching portion. The nozzle body 40 is an integrally molded product provided with a trumpet-like outer discharge port 41 discharging an agent from the outer container 11 via a communication hole 35 provided in the connecting member 30 in a narrow stream shape, and a trumpet-like inner discharge port 42 discharging an agent from the inner container 21 in a narrow stream shape. The nozzle body 40 screws and connects a threaded portion 43 corresponding to an outer periphery annular attaching and detaching portion coaxially arranged with the outer discharge port 41 into an outer peripheral threaded portion (a fitting portion) 33 of the connecting member 30 to be freely attached to and detached from the connecting member 30 in a liquid tight manner. The nozzle body 40 can close contact an outer seal portion 44A facing to the threaded portion 43 with an outer seal portion 34A of the connecting member 30 in a liquid tight manner, and can close contact a lower end seal portion 44B of the inner discharge port 42 with an inner peripheral seal portion 34B of the connecting member 30 in a liquid tight manner.

The container 10 is integrally provided with a drive-in portion 51 of a partition member 50 in a drive-in portion 45 arranged in an inner peripheral side with respect to the threaded portion 43 of the nozzle body 40 by driving in and connecting the drive-in portion 51.

The container 10 is structured such that a threaded portion 61 of a measuring cap 60 is screwed and connected to a threaded portion 52 of the partition member 50 integrally provided with the nozzle body 40 in a detachable and attachable manner. Further, the outer container 11 and the inner container 21 are respectively charged by different agents A and B which have different natures from each other, and the agents A and B are simultaneously discharged from the outer discharge port 41 and the inner discharge port 42 in the nozzle body 40, and are mixed in the measuring cap 60 by tilting of the container 10.

The container 10 is provided with an agent recovery means 70 in the nozzle body 40. In the agent recovery means 70, a recessed agent recovery portion 71 is formed in a portion connected to the drive-in portion 45 from the outer discharge port 41 of the nozzle 40, and this agent recovery portion 71 is arranged so as to be inserted to a depressed portion 36 connected to the outer threaded portion 33 from the inner peripheral threaded portion 32 of the connecting member 30. A liquid dripping off from the outer discharge port 41 and the inner discharge port 42 of the nozzle body 40 is recovered in the agent recovery portion 71. The partition member 50 is connected to the nozzle body 40 as mentioned above and is provided in an outer periphery of the discharge ports 41 and 42 of the outer container 11 and the inner container 21 and the agent recovery portion 71. The partition member 50 is structured such that an outer periphery of the partition member 50 is provided with an annular agent introduction recess portion 53 for introducing the agent dripping off from the measuring cap 60 and the discharge ports 41 and 42. The agent introduction recess portion 53 can be communicated with the agent recovery portion 70 in an inner peripheral side by a hole-like or a slit-like communication port 54. The communication port 54 is provided in a portion positioned in an opposite side to a portion in a side of a pouring direction of the container 10 (a portion in a side of a pouring direction of the discharge ports 41 and 42) with respect to the discharge ports 41 and 42 in the peripheral direction of the partition member 50, and an annular sub discharge port 55 connected to the agent recovery portion 70 in the inner peripheral side is formed so as to rise up from the agent introduction recess portion 53. In this case, the container 10 is provided with a grip portion such as a handle or the like indicating the direction in an opposite side to the pouring direction on an outer face of the outer container 11, thereby constructing informing means for informing the user of the pouring direction of the container 10. This means may be structured such as to indicate a side of the pouring direction of the container 10 by setting the position of the communication port 54 provided in the partition member 50 to the opposite side to the pouring direction.

The outer container 11, the inner container 21, the connecting member 30, the nozzle body 40, the partition member 50, and the measuring cap 60 are constituted by a resin molded product.

The connecting member 30 is formed as a tube body coaxially having an outer tube portion 30A, a middle tube portion 30B, and an inner tube portion 30C. The outer tube portion 30A is provided with a drive-in portion 31 to the outer container 11 (the drive-in portion 11A), an outer peripheral threaded portion 33 to the nozzle body 40 (the threaded portion 43 corresponding to the outer peripheral annular attaching and detaching portion), and an outer peripheral seal portion 34A to the nozzle body 40 (the outer seal portion 44A). The inner tube portion 30C is provided with a threaded portion 32 to the inner container 21 (the threaded portion 21A), and an inner peripheral seal portion 34B to the nozzle body 40 (the lower end seal portion 44B). The depressed portion 36 is formed by the middle tube portion 30B and the inner tube portion 30C, and the communication hole 35 is formed in a bottom portion of the depressed portion 36. Further, a reinforcing rib 37 is provided in a bottom portion of the depressed portion 36.

The nozzle body 40 is formed as a tube body coaxially having a screw-into tube portion 40A, a drive-in tube portion 40B, an outer nozzle portion 40C, and an inner nozzle portion 40D. The screw-into tube portion 40A is provided with the threaded portion 43 to the connecting member 30 (the outer peripheral threaded portion 33), the drive-in tube portion 40B is provided with the outer seal portion 44A to the connecting member 30 (the outer peripheral seal portion 34A) and the drive-in portion 45 to the partition member 50 (the drive-in portion 51), the outer nozzle portion 40C is provided with the outer discharge port 41, and the inner nozzle portion 40D is provided with the inner discharge port 42 and the lower end seal portion 44B. The agent recovery portion 71 is formed by the drive-in tube portion 40B and the outer nozzle portion 40C. A communication guide 46 for the outer discharge port 41 is provided between the outer nozzle portion 40C and the inner nozzle portion 40D, and a communication guide 47 for the inner discharge port 42 is provided in an inner portion of the inner nozzle portion 40D.

The partition member 50 is formed as a tube body coaxially having a drive-in tube portion 50A and a sub discharging tube portion 50B. The drive-in tube portion 50A is provided with a drive-in portion 51 to the nozzle body 40 (the drive-in portion 45), and the sub discharging tube portion 50B is provided with a threaded portion 52 to the measuring cap 60 (the threaded portion 61) and the sub discharge port 55. The partition member 50 is structured such that the drive-in tube portion 50A is provided with an annular seal portion 56 to which the measuring cap 60 is sealed, the agent introduction recess portion 53 mentioned above is formed in an inner side of the annular seal portion 56, and an outer side of the annular seal portion 56 is provided with a flange portion 57 sealed to the connecting member 30.

The measuring cap 60 is formed in a closed-end tubular shape, and is provided with an outer peripheral seal portion 62 sealed to the annular seal portion 56 of the partition member 50 in an outer periphery of a base end. The measuring cap 60 is provided with a screw portion 61 screwed with the threaded portion 52 of the partition member 50 in a back side of a ceiling, and is provided with seal portions 64 and 65 respectively sealed to the discharge ports 41 and 42 of the nozzle body 40.

In this case, the nozzle body 40 of the container 10 is structured such that the discharge ports 41 and 42 are formed as the tubular bodies as mentioned above, and center axes thereof are arranged coaxially. An annular gap between the outer discharge port 41 and the inner discharge port 42 forms a flow passage for the agent A in the outer container 11.

Further, the nozzle body 40 of the container 10 is structured such that the inner discharge port 42 is protruded to an outer side from the outer discharge port 41 in an axial direction, and each of the outer 25 discharge port 41 and the inner discharge port 42 is formed in a trumpet shape expanding to an outer side.

Further, the container 10 is structured such that the outer container 11 and the inner container 21 are formed as the tube bodies, and center axes of the nozzle bodies are arranged coaxially.

The container 10 is assembled in the following manner.

(1) The outer container 11 and the inner container 21 are connected by the connecting member 30 (FIG. 1).

(2) The contents are charged into the assembly of the outer container 11 and the inner container 21 obtained in accordance with the item (1). The agent B is charged into the inner container 21 (FIG. 3A), and the agent A is charged into the outer container 11 (FIG. 3B).

(3) The product container 10 is formed by assembling an assembly of the nozzle body 40, the partition member 50, and the measuring cap 60 (or a closing cover 80 mentioned below) in the connecting member 30 in the item (2) mentioned above (FIG. 4).

Figure 5:
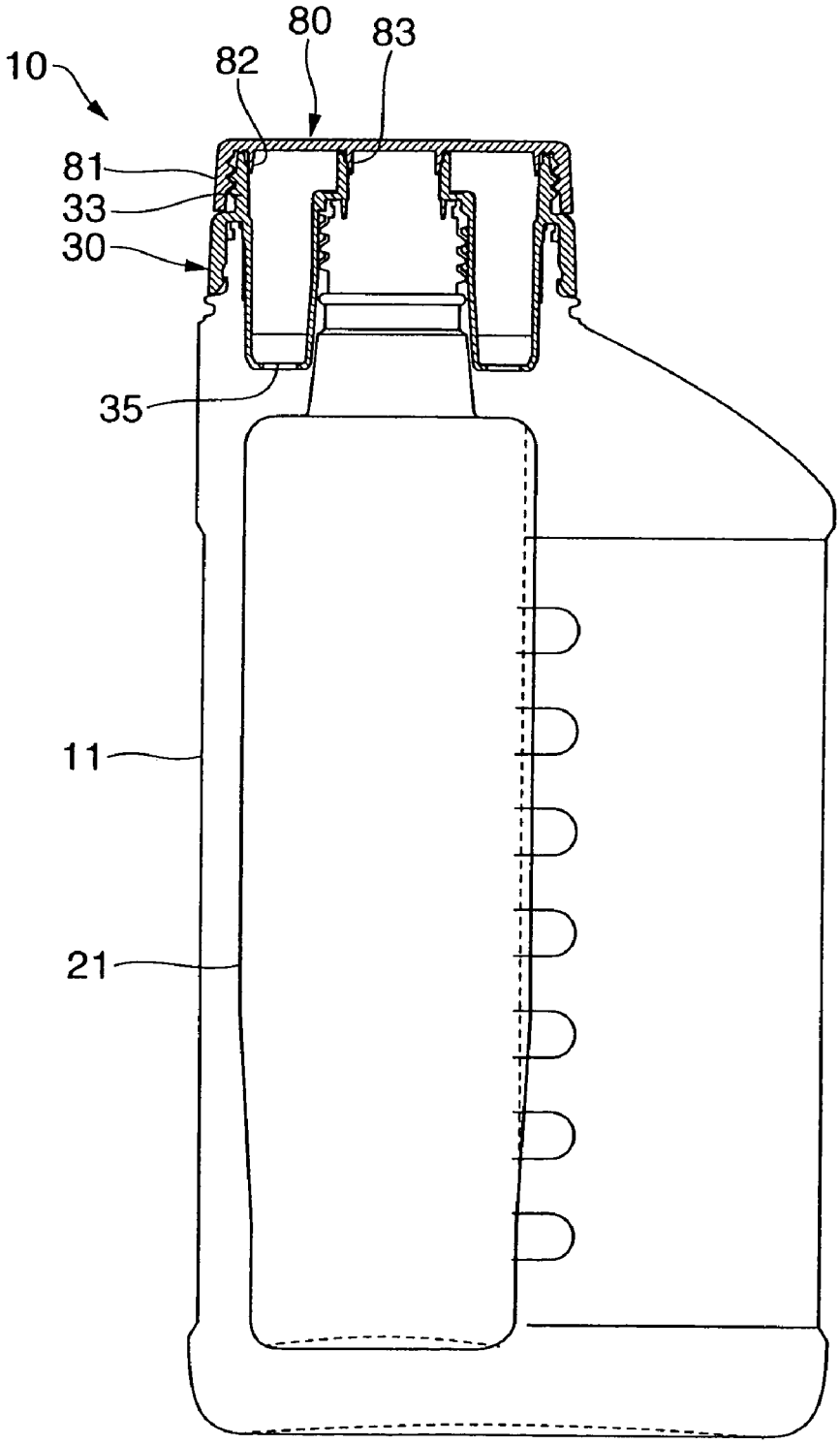
FIG. 5 is a schematic view showing a state in which a closing body is mounted to the container.

Further, the container 10 is structured, as shown in FIGS. 1 and 5, such that the closing cover 80 can be attached to and detached from the connecting member 30. The closing cover 80 is formed in a closed-end tubular shape, is provided with a threaded portion 81 to the connecting member 30 (the outer peripheral threaded portion 33) in an inner periphery of a base end, and is provided with a seal portion 82 to the connecting member 30 (the outer peripheral seal portion 34A of the outer tube portion 30A) and a seal portion 83 to the connecting member 30 (the inner peripheral seal portion 34B of the inner tube portion 30C) in a back side of a ceiling.

Figure 4:
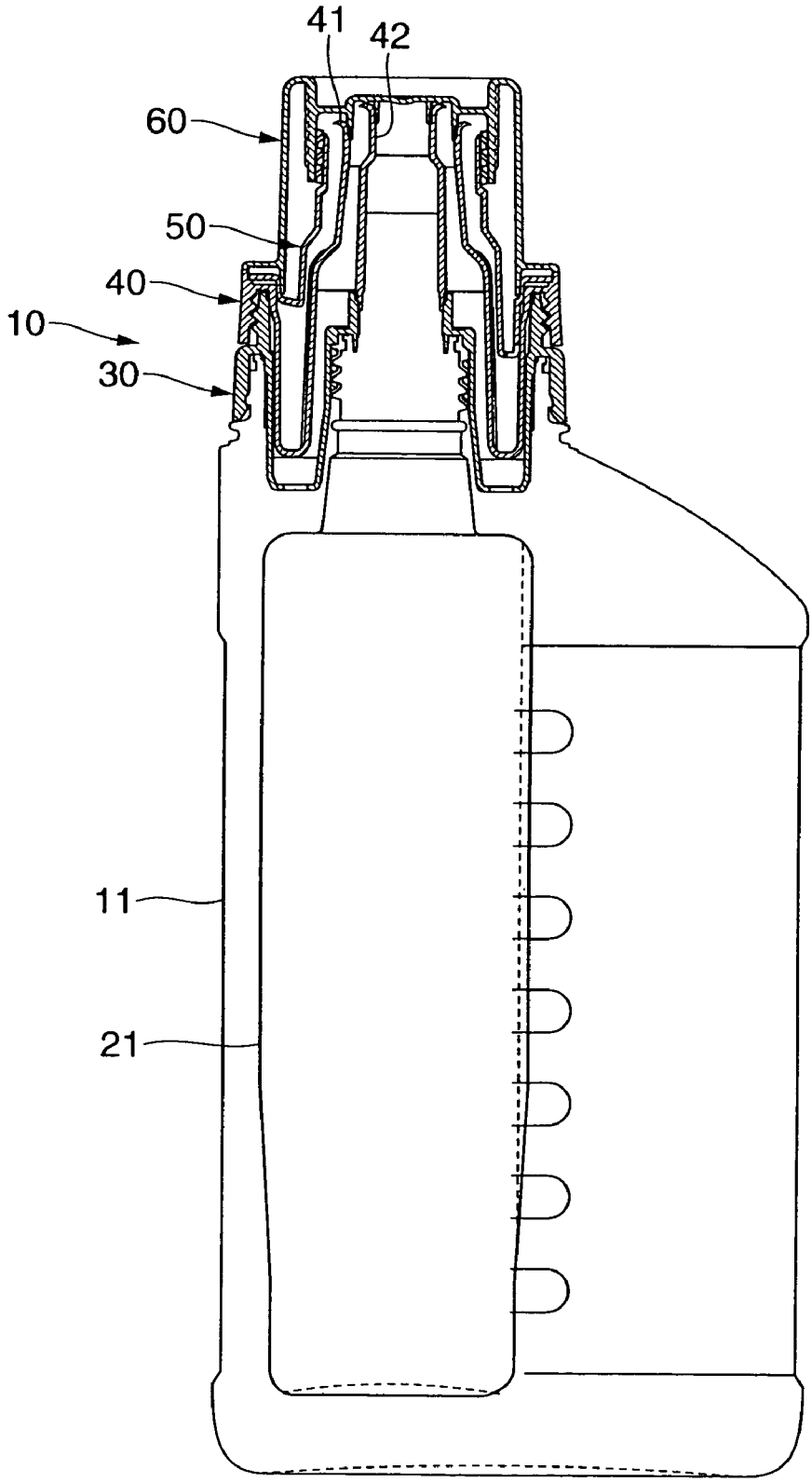
FIG. 4 is a schematic view showing a state in which a nozzle body is mounted to the container.

Accordingly, in the container 10, it is possible to set a structure in which the closing cover 80 is connected to the connecting member 30 in a manufacturing stage of charging the agents A and B into the outer container 11 and the inner container 21 to a physical distribution aspect (FIG. 5), and it is possible to set a structure in which the closing cover 80 is taken out and the assembly of the nozzle body 40 (the partition member 50 and the measuring cap 60) is replaced by the connecting member 30 to a use aspect (FIG. 4). Further, in a disposing stage after using the container 10, it is possible to set a structure in which the assembly of the nozzle body 40 (the partition member 50 and the measuring cap 60) is taken out and the closing cover 80 is replaced by the connecting member 30 to a disposal aspect (the same as in FIG. 5), and the removed nozzle body 40 (the partition member 50 and the measuring cap 60) is used as a recycle product to a new container 10.

Figure 6:
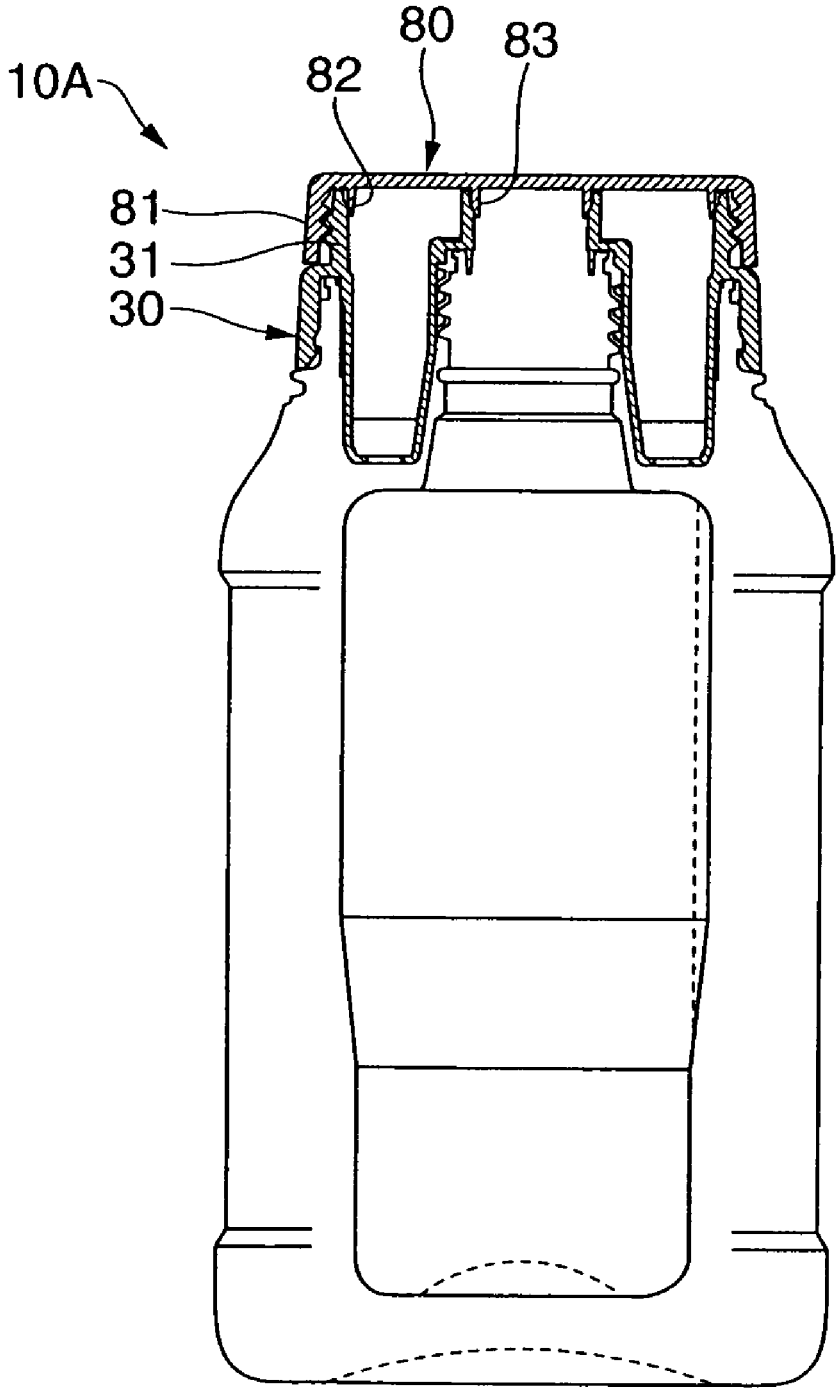
FIG. 6 is a schematic view showing a state in which the closing body is mounted to the other container.

In this case, the closing cover 80 may be run short by one time opening of the other kinds of products and may be used for a container 10A which does not require measuring (FIG. 6).

Therefore, in accordance with the present embodiment, the following effects can be obtained.

(1) The container 10 can simultaneously discharge the agent A in the outer container 11 and the agent B in the inner container 21 from the nozzle portions 40C and 40D of the nozzle body 40 only by being tilted without being squeezed. At this time, the agent A in the outer container 11 is discharged from a part in a lower side of the outer discharge port 41 of the outer nozzle portion 40C, the remaining portion of the outer discharge port 41 of the outer nozzle portion 40C functions as an air replacing passage, the agent B in the inner container 21 is discharged from a part of a lower side in the inner discharge port 42 of the inner nozzle portion 40D, and the remaining portion of the inner discharge port 42 of the inner nozzle portion 40D functions as air replacing passage, whereby the agents A and B are smoothly discharged.

(2) Since the outer nozzle portion 40C and the inner nozzle portion 40D are coaxially arranged, the flow passage of the outer nozzle portion 40C becomes uniform in the peripheral direction of the container 10 and the flow passage of the inner nozzle portion 40D becomes uniform in the peripheral direction of the container 10 at a time of tilting the container 10. Accordingly, as long as an angle of inclination of the container 10 is the same, it is possible to simultaneously discharge the agent A in the outer container 11 and the agent B in the inner container 21 from any portion in the peripheral direction of the nozzle portions 40C and 40D at a fixed rate of discharge amount irrespective of the gripping position in the peripheral direction of the container 10 performed by the user, respectively.

(3) Since the discharge port. 42 of the inner nozzle portion 40D is formed in the trumpet shape, a liquid stop performance of the discharge port 42 of the inner nozzle portion 40D is improved, and the agent A in the outer container 11 contacts with a back side of the trumpet-shaped discharge port 42 in the inner nozzle portion 40D to be inhibited from wrapping around a front side. Therefore, it is possible to prevent the agent B in the inner container 21 from making an intrusion into the outer container 11 and it is possible to prevent the agent A in the outer container 11 from making an intrusion into the inner container 21. Further, since the discharge port 41 of the outer nozzle portion 40C is formed in the trumpet shape, a liquid stop performance of the discharge port 41 in the outer nozzle portion 40C is improved.

(4) Since the inner nozzle portion 40D protrudes to the outer side from the outer nozzle portion 40C, the agent B discharged from the inner nozzle portion 40D drops along a front side of the outer nozzle portion 40C, and it is possible to prevent the agent B in the inner container 21 from making an intrusion into the outer container 11.

(5) In the case that the outer container 11 and the inner container 21 are concentrically arranged, the flow passage of the outer container 11 is uniform in the peripheral direction of the container 10, and the flow passage of the inner container 21 is also uniform in the peripheral direction of the container 10. Therefore, as long as the angle of inclination of the container 10 is the same, it is possible to make uniform each of a head pressure of the agent A in the outer container 11 applied to the discharge port 41 of the outer nozzle portion 40C, and a head pressure of the agent B in the inner container 21 applied to the discharge port 42 of the inner nozzle portion 40D, in any portion in the peripheral direction of the outer container 11 and the inner container 21, irrespective of the gripping direction in the peripheral direction of the container 10 performed by the user. And, it is possible to simultaneously discharge the agent A in the outer container 11 and the agent B in the inner container 21 from any portion in the peripheral direction of the nozzle portions 41 and 42 at a fixed rate of discharge amount.

(6) Since the outer container 11 and the inner container 21 are connected by the single connecting member 30, and the connecting member 30 is not separated into two pieces, the outer container 11 and the inner container 21 are not separated by the separation of the connecting member 30, so that it is possible to prevent the inner container 21 from falling away.

(7) Since the connecting member 30 is provided with the discharge port 42 from the inner container 21 and the discharge port 41 from the outer container 11, it is possible to simultaneously discharge the interior liquid solutions only by tilting the container 10.

(8) It is possible to simultaneously discharge the agents A and B having the different natures to the measuring cap 60 from the outer container 11 and the inner container 21 respectively at the fixed rate of discharge amount, and it is possible to mix both the agents A and B at a fixed mixing rate.

(9) The residual liquid at the previous measuring time left in the measuring cap 60 is introduced to the agent introduction recess portion 53 in the outer peripheral side of the partition member 50 from the measuring cap 60, and is recovered in the agent recovery portion 70 through the communication port 54. When tilting the container 10 at the next usage time of the container 10, the recovered agent stored in the agent recovery portion 70 is discharged from the sub-discharge port 55 through the inner surface of the partition member 50. Since the sub-discharge port 55 is formed in an uprising manner, the recovered agent can be poured toward a target position together with the discharge agents A and B from the discharge ports 41 and 42 corresponding to the main discharge ports without being dripped off in the peripheral portion so as to soil, even if the angle of inclination of the container 10 is as shallow as an angle of 0 to 5 degree.

(10) In this case, the communication port 54 communicated with the inner peripheral side from the outer peripheral side of the partition member 50 is positioned in the opposite position to the position in the pouring direction of the container 10 with respect to the discharge ports 41 and 42, and the recovered agent stored in the agent recovery portion 70 does not leak out to the outer surface side of the partition member 50 through the communication port 54, at a time of tilting the container 10 in the pouring direction.

(Other Effects)

(11) The communication guide 47 provided in the inner nozzle portion 40D functions as an insertion guide at a time of charging the agent B into the inner nozzle portion 40D, and an air replacement guide at a time of discharging the agent B from the inner nozzle portion 40D.

(12) Since the nozzle body 40 corresponding to an independent member is provided in the connecting member 30, the discharge port 41 for the outer container 11 can be provided in the connecting member 30 while the shape of the connecting member 30 is made as simple as possible.

(13) It is possible to simultaneously discharge the agents A and B having the different natures to the measuring cap 60 from the outer container 11 and the inner container 21 at the fixed rate of discharge amount respectively, and it is possible to mix both the agents A and B at the fixed mixing rate.

(14) In a state in which the outer container 11 and the inner container 21 are assembled by the connecting member 30, in the stage that the nozzle body 40 is not yet assembled, it is possible to secure a large opening for charging having no nozzle body 40 in each of the outer container 11 and the inner container 21 while the outer container 11 and the inner container 21 are in the assembled state, and it is possible to charge the agent into each of the containers 11 and 21 in their assembled state. Accordingly, it is possible to improve a productivity of the charging

(15) Since the structure is made such that the nozzle body 40 can be attached to and detached from the connecting member 30, it is easy to dispose the container 10 by taking out the nozzle body 40, the partition member 50, and the measuring cap 60 from the container 10, and it is possible to recycle the nozzle body 40, the partition member 50, and the measuring cap 60.

(16) It is possible to recover the residual liquid at the previous measuring time left in the measuring cap 60 by the agent recovery means 70.

(17) In the case that the contents A and B in the container 10 contain the surface active agent, it is possible to pour the surface active agent in the recovered agent introduced from the agent introduction recess portion 53 and recovered in the agent recovery portion 71 toward the target position together with the discharge agents A and B from the discharge ports 41 and 42 without being dripped off in the periphery to avoid soiling the periphery.

(18) Since the nozzle body 40 is constituted by the integrally molded product provided with the outer discharge port 41 and the inner discharge port 42, it is possible to make the nozzle body 40 by a single part, and it is possible to improve productivity in assembling the container 10.

(19) Since the structure is made such that the closing cover 80 and the nozzle body 40 can be attached to and detached from the connecting member 30 of the container 10 in a replaceable manner, it is possible to recycle the complex and expensive nozzle body 40 or the like repeatedly in the user side, by using the closing cover 80 in the physical distribution stage and the disposing stage, and using the assembly of the nozzle body 40, the partition member 50, and the measuring cap 60 in the using stage.

(20) It is possible to simultaneously discharge the agents A and B having the different natures to the measuring cap 60 from the respective discharge ports 41 and 42 of the outer container 11 and the inner container 21 at the fixed rate of discharge amount, and it is possible to mix both the agents A and B at the fixed mixing rate. Further, since the residual liquid left in the measuring cap 60 is recovered in the agent recovery portion 71 and is not recovered in the outer container 11 and the inner container 21, there is no risk that each of the content agents A and B in the outer container 11 and the inner container 21 is soiled.

(21) Since the outer container 11 and the inner container 21 are connected by the connecting member 30, it is hard to disengage the outer container 11 from the inner container 21. Further, the partition member 50 is connected to the connecting member 30, and the nozzle body 40 is held between the partition member 50 and the connecting member 30. Accordingly, the parts structure can be simplified such as the partition member 50 is used also as a fixing part for the nozzle body 40, and it is possible to improve an assembling property.

Figure 7:
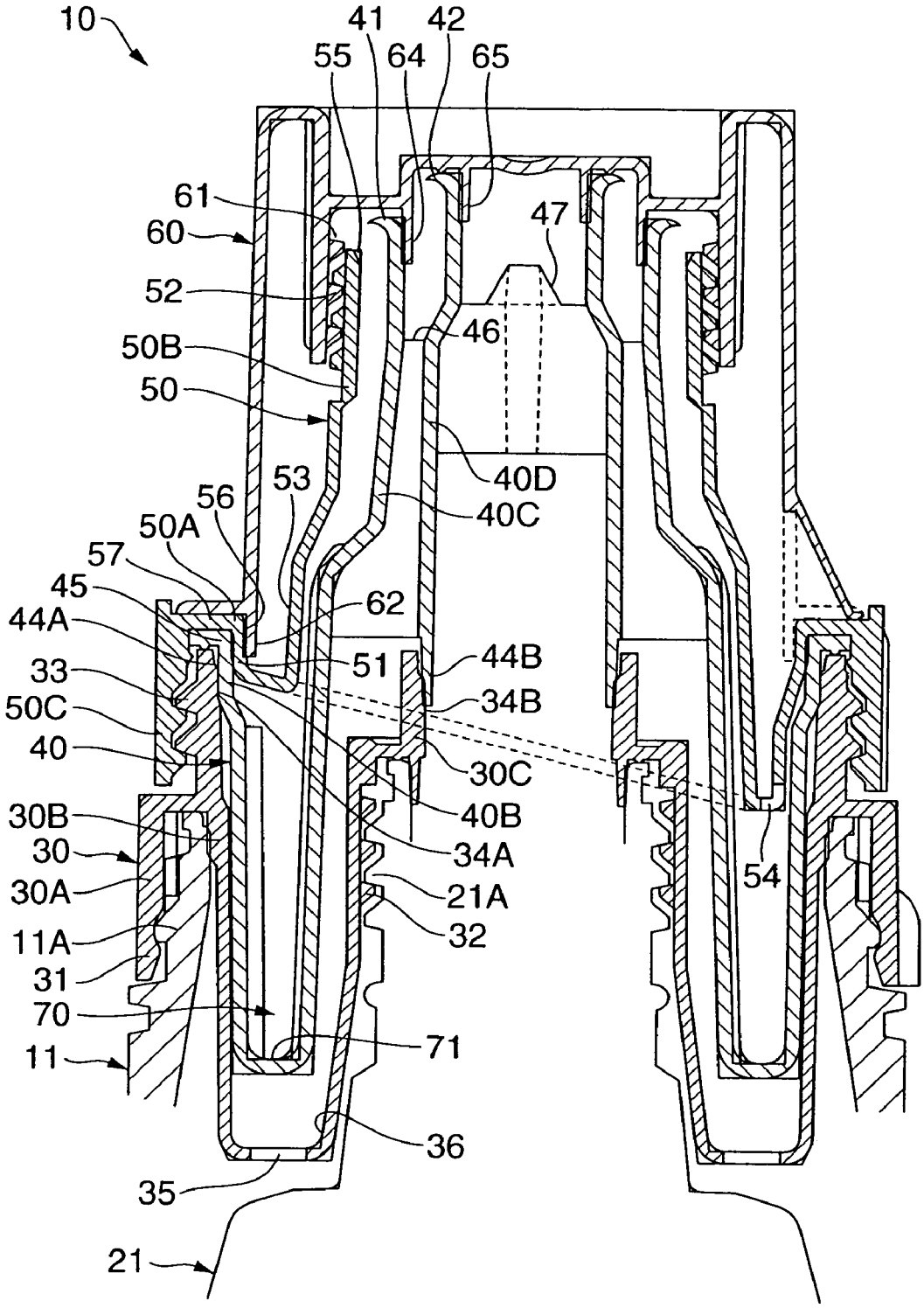
FIG. 7 is an enlarged cross sectional view of a main portion of a container in accordance a second embodiment.

(Second Embodiment) (FIG. 7)

A container 10 in accordance with a second embodiment is different from the container 10 in accordance with the first embodiment in a point of an attaching and detaching structure of the nozzle body 40 and the partition member 50 to the connecting member 30.

In the container 10 in accordance with the second embodiment, the screw-into tube portion 40A of the nozzle body 40 is removed, and the drive-in tube portion 50A of the partition member 50 is drive-in connected to the drive-in tube portion 40B of the nozzle body 40 to integrate both elements. And thereafter, a screw-in tube portion 50C newly provided in the periphery of the drive-in tube portion 50A in the partition member 50 is screw-into connected to the outer peripheral threaded portion 33 of the connecting member 30, to be detachably provided with the connecting member 30 in a liquid tight manner.

The container in accordance with the present invention may be a structure in which the outer nozzle portion 40D is integrally formed with the outer container 11, or a structure in which the inner nozzle portion 40D is integrally formed with the inner container 21. Further, the container 10 in accordance with the present invention may be provided with one or more middle container between the outermost outer container and the innermost inner container to simultaneously discharge three or more agents.

INDUSTRIAL APPLICABILITY

As described above, in accordance with the present invention, it is possible to simultaneously discharge the agent in the outer container and the agent in the inner container only by tilting the container.

Further, in accordance with the present invention, it is possible to simultaneously discharge the agent in the outer container and the agent in the inner container from any portion of the nozzles in the peripheral direction at the fixed rate of discharge amount.

Further, in accordance with the present invention, in the container in which the inner container is connected to the outer container, it is possible to prevent the inner container from falling away.

Still further, in accordance with the present invention, it is possible to recover the agent left in the measuring cap and it is possible to pour the recovered agent together with the discharge agent from the main discharge port at a next using time without being dripped off in the periphery.

In this case, in the embodiments in accordance with the present invention, the agent A in the outer container and the agent B in the inner container are exemplified by the following agents:

(1) Agent A: detergent or an alkali agent containing a surface active agent, agent B: oxygen type bleaching agent containing a surface active agent:

(2) (Skin lotion) Agent A: aroma chemical, Agent B: vitamin: and (3) (Dressing) Agent A: oil layer, Agent B: water layer (water layer containing watercolor). Further, the outer container and the inner container may be structured by a transparent material, and an agent A having a high transparency is charged in the outer container, whereby an agent B in the inner container is well visible.

What is claimed is:

1. A container comprising:

an inner container received in an outer container; and an inner nozzle portion received in an outer nozzle portion, in which agents respectively charged in the outer container and the inner container are simultaneously discharged from an outer discharge port of the outer nozzle portion and an inner discharge port of the inner nozzle portion by tilting the container, wherein the outer nozzle portion and the inner nozzle portion are coaxially arranged, an inner discharge port of the inner nozzle portion is formed in a trumpet shape, an outer discharge port of the outer nozzle portion is formed in a trumpet shape, the inner discharge port of the inner nozzle portion protrudes beyond an outer edge of the outer discharge port of the outer nozzle portion in an axial direction of the container, the outer container and the inner container are directly connected by a connecting member, and the connecting member is provided with a first discharge port configured to discharge an agent from the inner container and a second discharge port configured to discharge an agent from the outer container, and the connecting member is detachably connected to the inner and outer nozzle portions.

2. The container according to claim 1, wherein the outer container and the inner container are coaxially arranged.

3. The container according to claim 1, wherein the inner nozzle portion and the outer nozzle portion are connected to the inner container and outer container, respectively, by the connecting member, and the connecting member is disposed between the outer nozzle portion and the outer container.

4. The container according to claim 1, wherein the first port discharges the agent from the inner container into the inner discharge port of the inner nozzle.

5. The container according to claim 4, wherein the second port discharges the agent from the outer container into the outer discharge port of the outer nozzle.

6. A container comprising:

an inner container received in an outer container; and an inner nozzle portion received in an outer nozzle portion, in which agents respectively charged in the outer container and the inner container are simultaneously discharged from an outer discharge port of the outer nozzle portion and an inner discharge port of the inner nozzle portion by tilting the container, wherein an agent recovery portion is provided in a periphery of the outer discharge port and the inner discharge port, a partition member is provided in an outer periphery of the agent recovery portion, a measuring cap is detachably provided in the partition member, and the partition member is provided with an agent introduction recess portion configured to introduce the agent in an outer periphery thereof, the agent introduction recess portion configured to be communicated with the agent recovery portion by a communication port, the communication port provided in a portion positioned at an opposite side to a portion close to a pouring direction of the outer discharge port and the inner discharge port with respect to the outer discharge port and the inner discharge port in a peripheral direction of the partition member, and a sub-discharge port connected to the agent recovery portion is formed to rise up from the agent introduction recess portion.

7. The container according to claim 6, wherein the outer container and the inner container are coaxially arranged.

8. The container according to claim 6, wherein the outer container and the inner container are connected by a single connecting member, and the connecting member is provided with a discharge port for discharging an agent from the inner container and a discharge port for discharging an agent from the outer container.

* * * * *